United States Patent [19]

Pater et al.

[11] 4,094,252

[45] June 13, 1978

[54] SELF-CONTROLLED ON-GRADE MONORAIL TRACK SWITCH AND METHOD

[75] Inventors: Hendrik Pater, 4154 Parkview Dr., Salt Lake City, Utah 84117; G. Earl Torgersen, Salt Lake City; Fritz R. Brunner, Murray, both of Utah

[73] Assignee: Hendrik Pater, Salt Lake City, Utah

[21] Appl. No.: 679,266

[22] Filed: Apr. 22, 1976

[51] Int. Cl.[2] ..... E01B 7/00

[52] U.S. Cl. ..... 104/130; 104/38; 104/47; 246/114 A; 246/115

[58] Field of Search ..... 104/35, 36, 38, 47, 104/118, 120, 121, 130; 105/141, 145; 246/111, 113, 114 R, 114 A, 115

[56] References Cited

U.S. PATENT DOCUMENTS

| | | | |
|---|---|---|---|
| 1,068,807 | 7/1913 | Murray | 104/38 |
| 1,600,767 | 9/1926 | Lockwood | 104/120 |
| 1,800,722 | 4/1931 | Edson | 104/38 |
| 2,841,699 | 7/1958 | Kemmerer | 246/114 R |
| 2,881,308 | 4/1959 | Quinlan | 246/114 R |
| 2,987,008 | 6/1961 | Melmer | 104/36 |
| 3,106,898 | 10/1963 | Prosin | 104/130 |
| 3,524,054 | 8/1970 | Smith | 246/114 R |
| 3,575,596 | 4/1971 | Schatzel | 246/114 R |
| 3,735,709 | 5/1973 | Matsumoto et al. | 104/130 |
| 3,747,537 | 7/1973 | Matsumoto et al. | 104/38 |

FOREIGN PATENT DOCUMENTS

| | | | |
|---|---|---|---|
| 2,348,721 | 10/1975 | Germany | 246/115 |

*Primary Examiner*—Robert G. Sheridan
*Assistant Examiner*—Carl Rowold
*Attorney, Agent, or Firm*—H. Ross Workman; J. Winslow Young

[57] ABSTRACT

A monorail track switch and method is disclosed wherein the track switch senses the approach of a train and automatically aligns itself to accommodate passage of the train. Circuits are provided to selectively deenergize a movable track section when in nonaligned position and to re-energize the track section when properly aligned. Novel structure and method is also provided for lowering the movable track section onto rollers to facilitate movement and thereafter lifting the track section into horizontal alignment with the train path. Electronic lockout circuits prevent a train from overrunning the switch when the switch is in a nonaligned position.

20 Claims, 6 Drawing Figures

SELF-CONTROLLED ON-GRADE MONORAIL TRACK SWITCH AND METHOD

BACKGROUND

1. Field of the Invention

This invention relates to on-grade track switches and more particularly to a self-controlled on-grade track switch that senses the approach of an oncoming train and thereafter automatically controls the positioning and locking of the switch to accommodate passage by the train.

2. The Prior Art

The need for efficient and reliable mass transit systems has long been recognized. Relatively recent efforts to provide efficient mass transit have led to the development of monorail transportation systems for use in and around major centers of activity. Monorail transportation systems have proven to be a viable solution to the transportation needs for large numbers of commuters to and from congested centers of activity.

In an attempt to increase efficiency and reduce cost, designers of monorail mass transit systems have focused attention on efficient utilization of the track. Central to the problem of providing a flexible and low cost track layout is the problem of providing means for switching vehicles from one track to another so as to utilize more track in less space.

On-grade track switches of a Y configuration are well known in the prior art. In this type of device one end of the switch is pivoted where it joins a main track and the other end is free to swing from the main track to a branch track. For example, U.S. Pat. Nos. 313,830, 3,013,504 and 3,106,898. Also known in the prior art are on-grade track switches which utilize a centrally pivoted switch. This type of switch is capable of joining the ends of several main track sections as it rotates in a circular fashion from position to position. For example, see U.S. Pat. No. 2,977,893. Also known in the prior art are on-grade track switches of a Y configuration which are capable of being shifted laterally to provide for branching from a main track to a side track. Examples of this type of device are illustrated in U.S. Pat. Nos. 2,977,892 and 3,735,709.

Relatively recent efforts directed toward increasing the efficiency of mass transit systems through automation have led to the development and use of energized monorail tracks. Vehicles traveling on these types of energized tracks are powered by electricity conducted along the tracks. However, use of energized track systems has further complicated the problems relating to on-grade track switching. Efforts have been made in the past to automatically control the energization and de-energization of on-grade track switching devices while changing their position from one track to another. See, for example, U.S. Pat. No. 3,735,709.

Manual control over the response of an on-grade track switch to an oncoming vehicle renders an otherwise automatic mass transit system less flexible and more dependent upon human control, thereby reducing efficiency and increasing the change for error.

BRIEF SUMMARY AND OBJECTS OF THE INVENTION

The present invention provides for a self-controlled on-grade switch disposed between the ends of converging tracks. The tracks are energized and provide power to a vehicle traveling on the tracks. The switch of this invention automatically senses the approach of any vehicle on any one of the converging tracks, and thereafter automatically responds to the first signal received and positions itself to accommodate passage by that vehicle. Subsequently approaching trains traveling on tracks not aligned with the switch are disabled a selected distance from the switch. When a train has advanced to within a preselected distance of the switch, it is automatically disabled so as to prevent any movement of the switch until the train has safely passed.

It is therefore a primary object of the present invention to provide an improved on-grade switch that automatically senses the approach of an oncoming vehicle on one of a plurality of converging tracks and automatically responds by positioning itself to accommodate passage by that vehicle.

It is another primary object of the present invention to provide a reliable and safe method for automatically sensing the position and controlling the movement of an on-grade switch.

It is another object of the present invention to provide for improved structure and method for locking the on-grade switch to the ends of the converging tracks.

Another important object of the invention is to provide supports for the rotatable switch and structure and method for lifting the switch off the supports.

It is yet another object of the present invention to provide structure and method whereby all converging tracks which are not joined to the on-grade switch are automatically disabled within a selected distance from the switch so as to prevent derailment.

It is yet one further object of the present invention to provide structure and method whereby the switch is automatically prevented from moving after a train has come within a selected distance of the switch.

These and other objects and features of the present invention will become more fully apparent from the following description and appended claims taken in conjunction with the accompanying drawings.

BRIEF DESCRIPTION OF THE DRAWINGS

FIGS. 4 and 5 further illustrate the lifting action of the on-grade cross-over switch upon being locked to the ends of the converging tracks.

DETAILED DESCRIPTION OF THE PREFERRED EMBODIMENTS

Attention is now directed to the preferred embodiments of the invention more particularly set forth in the figures, like parts having like numerals throughout.

GENERAL DESCRIPTION OF THE ON-GRADE SWITCH AND TRANSIT SYSTEM

Figure 1:
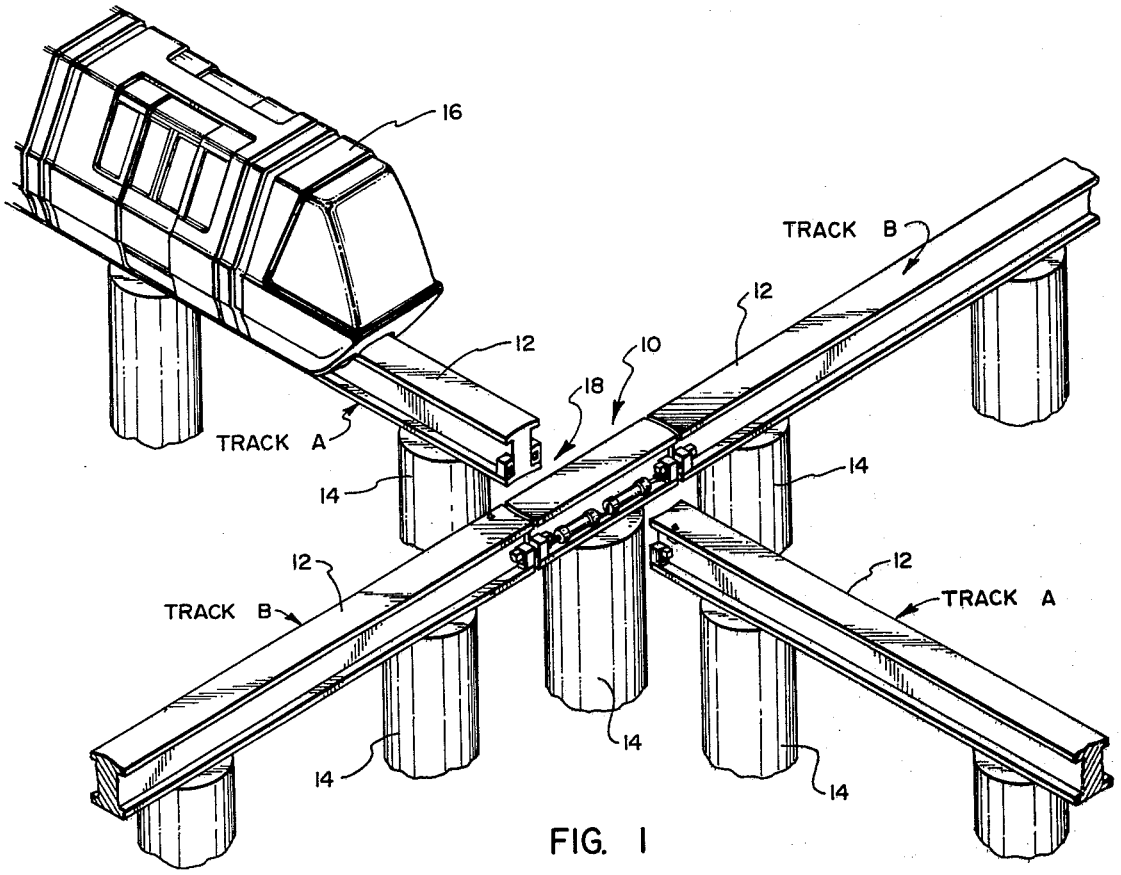
FIG. 1 is a perspective illustration of a presently preferred embodiment of a self-controlled on-grade cross-over switch disposed between the ends of four converging tracks of a monorail mass transit system.

In order to more fully understand the apparatus and method of the present invention, brief reference is made to a mass transit system with which the present invention may be used. Referring now to FIG. 1, a self-controlled on-grade junction switch generally designated 10 is shown disposed between the ends of converging monorail tracks 12, for convenience designated Track A and Track B. The switch 10 and monorail tracks are of a generally I-beam cross-sectional shape. The cross-over switch generally designated 10 and the monorail tracks 12 are each supported by a plurality of support structures 14. Each monorail track 12 contains structure (not shown) for continuously conducting electricity along the entire length of track 12. The electricity conducted along the tracks 12 is used to power an autopiloted train 16.

The autopiloted train 16 continuously causes a control voltage signal to be conducted along a portion of the monorail track 12. The train 16 traveling on the monorail track 12 monitors the track 12 by sensing a variation in the control signal. Variation in the control signal may be caused by such events as the approach of the train 16 toward an open portion of track generally designated 18 or another train (not shown). When the voltage signal rises to a preselected level, the autopiloted train 16 will sense that the signal is at the preselected level and will automatically slow or stop the train 16 in response to the signal. Although the self-controlled on-grade switch 10 of the present invention may be utilized with other mass transit systems, a system as described above which is capable of using the present invention is produced by Universal Mobility Incorporated, having a principal place of business at 2040 East 4800 South, Salt Lake City, Utah and marketed under the trademark UNIMOBIL Transit Systems.

Having now generally described a mass transit system with which the self-controlled on-grade cross-over switch of the present invention may be utilized, attention is now turned to a detailed description of the apparatus and method of operation of a preferred embodiment of the invention.

THE APPARATUS

It will be understood from the following that the present invention may be used with any on-grade switching system including converging Y-switches, cross-over switches and the like where a track section is translated from one position to another. For convenience of illustration, the presently preferred embodiment of an on-grade cross-over switch will be described.

Figure 3:
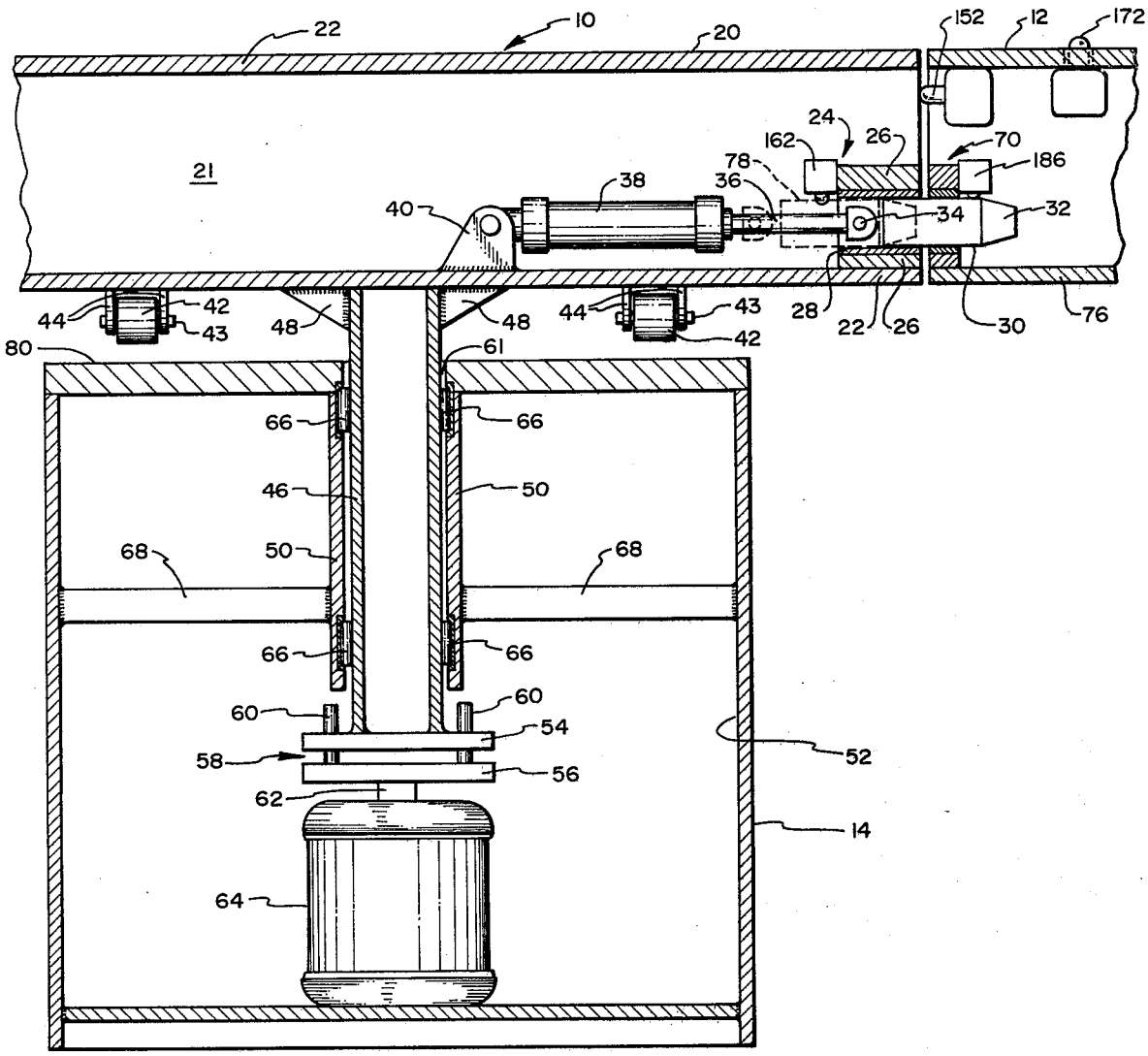
FIG. 3 is a side elevational view shown partially in cross section.

Reference is now made to FIG. 3 which illustrates a side elevational view shown partially in cross section of a presently preferred embodiment of the invention. As shown in FIG. 3, the on-grade cross-over switch generally designated 10 has a rotatable track section 20 having a generally I-beam cross-sectional shape. Flanges 22 project horizontally outward from the generally vertical body 21 of the I-beam track section 20. The length of the rotatable track section 20 may be of any desirable dimension which will permit passage of the train 16 through the cross-over switch 10.

A locking pin sleeve generally designated 24 is connected to the bottom flange 22 of each side of the rotatable track section 20. For convenience of illustration, only one locking pin sleeve 24 is shown in FIG. 3, it being understood that all are essentially identical in construction. As more clearly shown in the enlarged illustrations of FIGS. 4 and 5, the locking pin sleeve generally designated 24 is further comprised of a cylindrical collar 26 which contains a hollow cylindrical bearing 28. Each locking pin sleeve generally designated 24 is mounted on the flanges 22 so that one of its ends is flush with the end of the rotatable track section 20 which adjoins the converging track 12. A cylindrically shaped locking pin 30 is seated slidably within the cylindrical bearing 28 of each locking pin sleeve 24. The leading end 32 of the locking pin 30 is forwardly tapered. The trailing end of the locking pin 30 is connected by a wrist pin 34 to a hydraulically driven piston rod 36 of a hydraulic cylinder 38. The hydraulic cylinder 38 is buttressed by an upright frame 40 which is rigidly mounted to the flange 22 of the rotatable track section 20. The cylinder 38 is hydraulically operated in a conventional manner by a pump (not shown) as will be subsequently more fully described.

Another locking pin sleeve generally designated 70 having an outer cylindrical collar 72 which contains a hollow cylindrical bearing 74 (see FIGS. 4 and 5) is connected to the bottom flange 76 on each side of each converging track 12. Each locking pin sleeve 70 located at the end of the converging track 12 is positioned vertically so as to mate with the locking pin 30 when the hydraulically driven piston rod 36 is fully extended to the solid line position shown in FIG. 3. When the locking pins 30 are extended into sleeves 70, the bearings 28 and 74 are in axial alignment and movement of the track section 20 is precluded in both the vertical and horizontal planes. When the pins 30 are moved to the broken line position of FIG. 3, the track section 30 is free to move in both vertical and horizontal planes as will be subsequently discussed.

Figure 2:
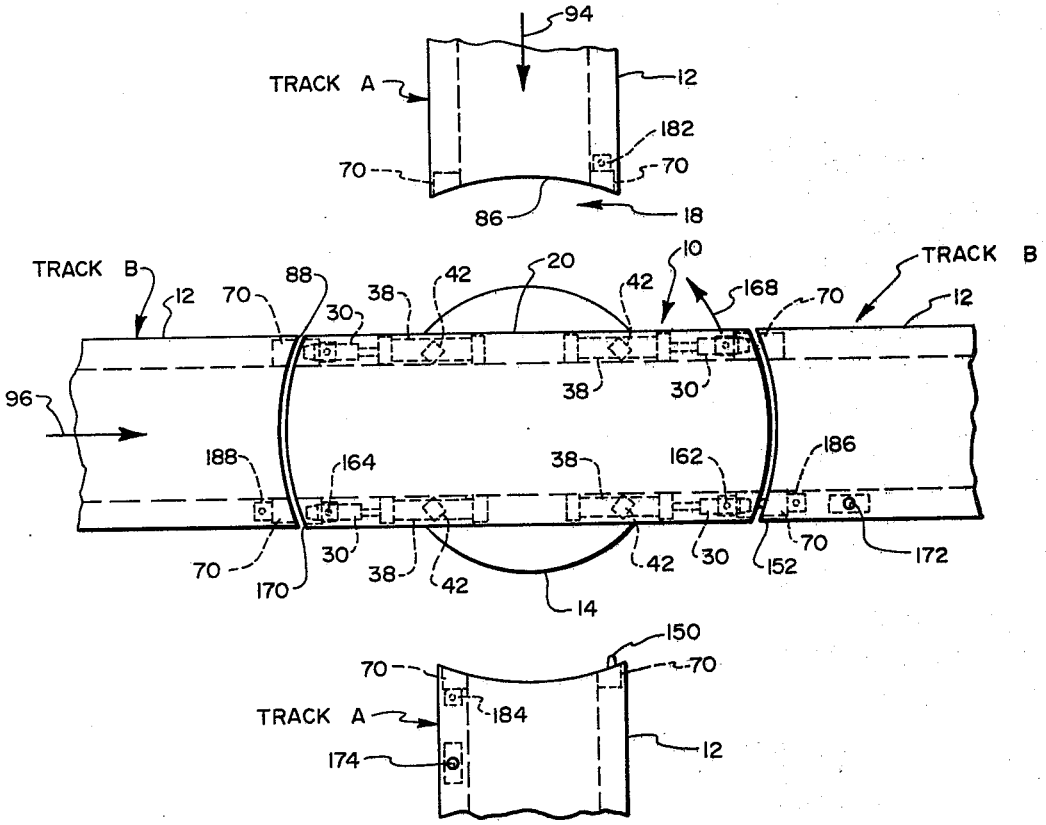
FIG. 2 is a plan view of the cross-over switch of FIG. 1, portions being illustrated in broken lines.

As more clearly illustrated by the plan view of FIG. 2, each end of the rotatable track section 20 has two hydraulic cylinders 38 and two locking pins 30 which mate with corresponding locking pin sleeves 70 in the ends of the converging tracks 12.

Referring again to FIG. 3, the rotatable track section 20 is supported by a vertical cylindrical column 46. Triangularly shaped braces 48 are welded or otherwise suitably connected to the top end of the column 46 and to the underside of the rotatable track section 20, thereby providing additional support for the rotatable track section 20. The vertical column 46 extends through an inwardly projecting sleeve 50 into a chamber 52 inside the support structure 14. The lower end of column 46 is connected to a top plate 54 of a slide pin coupling generally designated 58. A parallel, similarly configurated bottom plate 56 is, in the position illustrated, spaced from plate 54. Bottom plate 56 has a plurality of integral upwardly directed dowels 60 which project through diametrally enlarged apertures formed at corresponding locations in plate 54. The bottom plate 56 is connected to a shaft 62 of a torque drive motor 64, housed within the chamber 52 of the support structure 14. As will be more fully described in subsequent portions of the specification, the torque drive motor 64 rotates the bottom plate 56 which in turn rotates, through the dowels 60, the top plate 54, column 46 and the track section 20 about an essentially vertical axis. The slide pin coupling 58 permits vertical displacement of the track section 20 without inhibiting the rotation thereof.

Rotation-translation bearings 66 are provided along the inside of the inwardly projecting sleeve 50 to facilitate rotational and vertical movement of the cylindrical column 46. Struts 68 rigidly mount the sleeve 50 within the support structure 14.

The support structure 14 is closed at the top with a structural platform 80. The platform 80 has a central bore 61 through which the column 46 rotatably passes. The inwardly projecting sleeve 50 is mounted on the underside of platform 80. Significantly, platform 80 presents a generally smooth upper surface which wheels 42 selectively engage. Wheels 42 are mounted to the underside of track section 20 with yokes 44 and revolve on axles 43.

Figure 4:
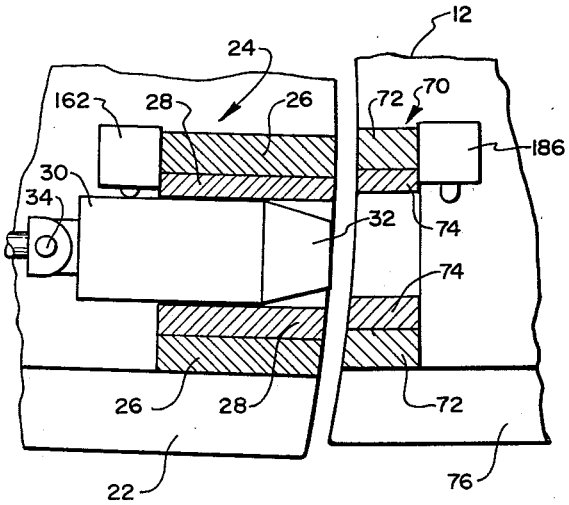
FIGS. 4 and 5 are enlarged cross-sectional views of presently preferred structure for locking the on-grade cross-over switch to the ends of the converging tracks.
Figure 5:
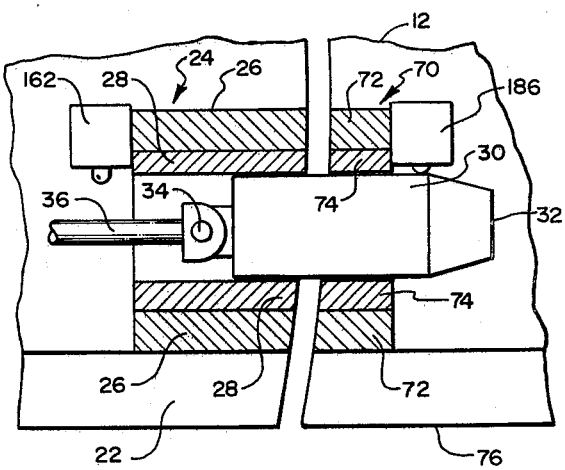

Referring still to FIG. 3, it should be noted that when the locking pins 30 are retracted to the position 78 shown by broken lines, the rotatable track section 20 is lowered vertically until the wheels 42 rest on the platform 80 of the support structure 14. This drops the sleeve 24 out of direct alignment with sleeve 70, as shown in FIG. 4. After the rotatable track section 20 has been rotated into alignment with a converging track 12, it is ready to be relocked to the track 12. As shown in FIGS. 4 and 5, as the tapered ends 32 of the locking pins 30 engage the bearings 74 of the locking pin sleeves 70, the tapered ends 32 of the locking pins 30 exert a lifting force on the rotatable track section 20 as the pins 30 are fully extended. Thus, when locked to the tracks 12, the wheels 42 connected to the rotatable track section 20 are lifted off the platform 80. This keeps the wheels 42 from bearing the weight of the train 16 as the train passes over the track section 20.

Having now described the essential structure of the preferred embodiment of the invention, attention is now focused on the electrical control circuit and method of operation of the invention.

THE ELECTRICAL CONTROL CIRCUIT AND METHOD OF OPERATION

Figure 6:
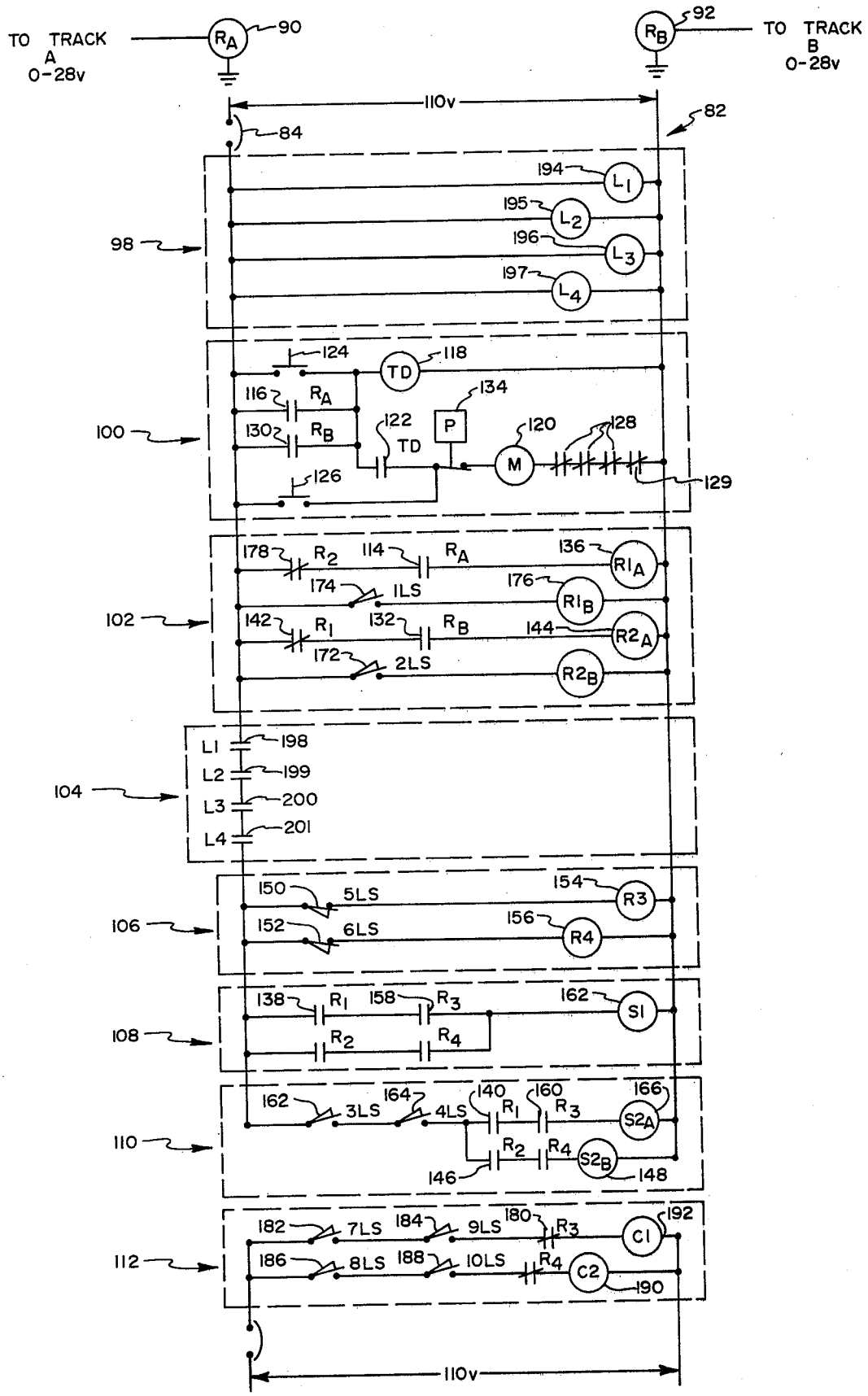
FIG. 6 is a schematic diagram of the electrical control circuit used for sensing the position and controlling the movement and locking of the on-grade cross-over switch.

The electrical control circuit generally designated 82 in FIG. 6 is connected through a circuit breaker 84 to a conventional 110 volt voltage source (not shown). A variable voltage sensing relay 90 is coupled to the end 86 of Track A (see FIG. 2). Another variable voltage sensing relay 92 is coupled to the end 88 of Track B (FIG. 2). For purposes of illustration, it will be assumed in the following description of the method of operation, that the rotatable track section 20 is aligned with Track B as shown in FIGS. 1 and 2 and that the autopiloted train 16 is approaching the rotatable track section on Track A from the direction shown by the arrow 94.

As previously described, as the train 16 travels on the tracks 12, a variable voltage signal is generated. The voltage source may originate with the train 16 or at the switch 10, it being understood that as the voltage is influenced by the train 16, the resulting signal is referred to herein as "originating" with or "generated" by the train. Since this voltage signal is proportional to the free distance between the train 16 and a de-energized or open portion of track, as the train 16 approaches the end 86 of Track A (FIG. 2), the voltage signal increases since the rotatable track section 20 is not aligned with Track A. When the variable voltage signal rises to a preselected level, the voltage sensing relay 90 (FIG. 6) is activated.

As shown in FIG. 6, the electrical control circuit generally designated 82 has been divided into eight functional components designated by the broken line boxes. The functional components are generally designated as: lockout safety sensors 98, hydraulic pump control circuit 100, master enable and disable control circuit 102, safety lockouts 104, track position control circuit 106, track-locking mechanism control circuit 108, rotational movement control circuit 110 and power control circuit 112. It should also be noted in FIG. 6 that each contact contains a letter designation "R" having a numerical (1, 2, 3 or 4) or a letter (A or B) subscript. All contacts which are operated by a given relay having an "R" designation with a subscript will have the same designation as the relay which operates it. For example, all contacts simultaneously operated by relay "RA" (90 of FIG. 6) will also be designated "RA". Relays that operate the same contacts but which are ultimately associated with different tracks will have a second subscript "A" or "B" corresponding to Track A or Track B. For example, both relays "R2A" (144 of FIG. 6) and "R2B" (176 of FIG. 6) operate all contacts designated "R2". However, only relay "R2A" or "R2B" will operate at any given time, as will be hereinafter more fully described, since relay "R2A" is associated with Track A and relay "R2B" is associated with Track B.

When the voltage sensing relay 90 is activated by the signal of the approaching train 16 as described above, relay 90 in turn closes contact 114 of the selective enable and disable control circuit 102 and also contact 116 of the hydraulic pump control circuit 100. When contact 116 closes, a time delay relay 118 and a motor control starter coil 120 of the hydraulic pump control 100 are energized. The energization of the motor control starter coil 120 starts a motor (not shown) which drives a hydraulic pump (also not shown) providing the hydraulic force utilized by the locking pins 30 (see FIG. 2) in locking and unlocking the rotatable track section 20 to the converging tracks 12. After a predetermined length of time, the energized time delay relay 118 causes a normally closed contact 122 to open, thereby turning off the motor control starter coil 120 which in turn stops the motor that is driving the hydraulic pump (not shown). The hydraulic pump control circuit 100 is also equipped with a test button 124 and a manual run button 126 for purposes of testing or manually starting the hydraulic pump control circuit 100. The hydraulic pump control circuit 100 is further equipped with three motor overload contacts 128 and one hydraulic oil overheat cutout 129 which automatically turn the motor control starter coil 120 off if the motor of the hydraulic pump (not shown) becomes overloaded or the oil is overheated.

When the normally open contact 114 of the selective enable and disable control circuit 102 is closed by the voltage relay 90 in response to the approaching vehicle 16 on Track A as described above, a relay coil 136 is energized. When the relay 136 is energized, normally open contacts 138 of the locking mechanism control circuit 108 and 140 of the rotational movement control circuit 110 are closed, thereby partially enabling the track-locking mechanism control circuit 108 and the rotational movement control circuit 110.

At the same time that the relay 136 partially enables the track locking control circuit 108 and the rotational movement control circuit 110 by closing contacts 138 and 140 respectively, relay 136 simultaneously opens normally closed contact 142 of the enabling and disabling control circuit 102. By opening the contact 142, relay 144 is disabled so that it cannot respond even if contact 132 is closed due to a signal picked up by the voltage sensing relay 92 of Track B. Furthermore, since relay 144 also controls contact 146 of the rotational control circuit 110, by disabling relay 144, contact 146 of the rotational movement control circuit 110 is kept open. By keeping the contact 146 open, the solenoid valve coil 148 cannot be energized. The solenoid valve coil 148 controls the rotational movement of the track section 20 into alignment with Track B.

Thus, it should be noted that the enabling and disabling control circuit 102 provides the important function of simultaneously (1) disabling any response of the torque drive motor 64 (FIG. 3) to any signal subsequently picked up on Track B by voltage sensing relay 92 after the signal from a train on Track A has been picked up by relay 90, and (2) partially enabling retraction of the locking pins 30 and partially enabling energization of the torque drive motor 64 (FIG. 3) in response to the signal from train 16 on Track A. The locking pins 30 and torque drive motor 64 cannot be completely enabled until the track position control circuit 106 determines whether the track section 20 is already in the aligned position.

In order to ensure that the track section 20 is not rotated if it is already in the correct position to accommodate passage of the oncoming train 16, position sensing limit switches 150 and 152 of the track position control circuit 106 are located at the ends of Track A and Track B respectively, as shown in FIGS. 2 and 3. When the rotatable track section 20 is aligned with Track B as shown in FIGS. 2 and 3, then the normally closed switch 152 will be forcibly depressed to the open position. Referring now again to FIG. 6, since the limit switch 152 is forcibly depressed the relay 156 will be de-energized. Conversely, since the normally closed limit switch 150 associated with the end of Track A is not depressed, the relay 154 will be energized. Since the relay 154 is energized, normally open contacts 158 of the locking mechanism control circuit and 160 of the rotational movement control circuit which are controlled by relay 154 will be closed. Normally closed contact 180 of the power control circuit 112 will be opened. Since contact 158 of the locking mechanism control circuit will be closed by relay 154 and since contact 138 of the locking mechanism control circuit 108 has been already closed in response to the signal generated on Track A as previously described, the solenoid valve coil 162 which operates the retraction of the locking pins 30 will be energized, thereby retracting the locking pins 30 (as shown in FIG. 4).

It should be noted that had the rotatable track section 20 already been aligned with Track A so as to accommodate passage by the train 16 approaching on Track A, the limit switch 150 would have been forcibly depressed by the end of the rotatable track section 20, thereby maintaining relay 154 de-energized. This in turn would have kept contact 158 of the locking mechanism control circuit 108 and contact 160 of the rotational movement control circuit 110 open, thereby disabling the circuits that control the unlocking and rotational movement of the rotatable track section 20.

In order to sense when the locking pins 30 have been completely retracted so as to enable rotation of the track section 20, the limit switches 162 and 164 of the rotational movement control circuit 110 are positioned on opposite ends of the track section 20 as illustrated in FIG. 2. As further illustrated in FIGS. 4 and 5, when locking pins 30 are extended as in FIG. 5 the limit switch 162 (FIG. 5) and the limit switch 164 (FIG. 2) are open. As illustrated in FIG. 6, when the limit switches 162 and 164 are open, the rotational movement control circuit 110 is de-energized. This prohibits energizing the torque drive motor 64 when the track section 20 is locked.

When the locking pins 30 are retracted as shown in FIG. 4, the limit switch 162 and the limit switch 164 are closed. Referring again to FIG. 6, when limit switches 162 and 164 are closed by the retracted locking pins 30, the solenoid closing valve 166 which enables rotation of the track segment 20 into alignment with Track A is energized, since contacts 160 and 140 have been previously closed in response to the position sensing circuit 106 and the signal generated by the approaching train 16 on Track A. Once the solenoid closing valve 166 is energized, the rotational torque drive motor 64 (shown in FIG. 3) is started. The track section 20 is then rotated about an essentially vertical axis in the direction shown by the arrow 168 of FIG. 2 until the leading edge 170 of the track section 20 engages limit switch 150 positioned on Track A. Once the leading edge 170 of the track section 20 engages normally closed limit switch 150, the limit switch 150 will be forcibly depressed to open. Referring again now to FIG. 6, when the limit switch 150 is depressed relay 154 will be de-energized. When relay 154 is de-energized the contact 158 of the locking mechanism control circuit 108 and contact 160 of the rotational movement control circuit 110 which were previously closed will return to their normally open position. As the contact 158 of the locking mechanism control circuit returns to its normal open position, the solenoid closing valve 162 will be de-energized thereby driving the locking pins 30 into the sleeve 70 (FIGS. 3 and 5). When the locking pins 30 return to their extended position, they will engage the locking pin sleeves 70 located in the ends of Track A and will firmly lock the rotatable track section 20 into position.

When contact 160 of the rotational movement circuit 110 returns to open as a result of de-energization of relay 154 as described above, solenoid closing valve 166 will be likewise de-energized and consequently the torque drive motor 64 (shown in FIG. 3) will be turned off. Thus at this point, the rotatable track section 20 will be aligned with the path of the oncoming train 16 approaching from Track A and will be firmly locked to the ends of Track A so as to accommodate passage by the train 16.

It should be noted in FIG. 6 that the electrical control circuit 82 has been equipped with inductive loop sensing relays 194 to 197. Although not necessary to the basic functions of controlling the movement and locking of track section 20, relays 194 to 197 provide a redundant safety system for the cross-over switch 10. Each relay 194 to 197 controls a corresponding series lockout contact 198 to 201 which is normally open. The relays 194 to 197 are each associated with one of the converging tracks 12. Each relay 194 to 197 is continuously energized so as to maintain contacts 198 to 201 closed, thereby providing continuity with the 110 v energy source for the position sensing circuit 106, locking control circuit 108 and movement control circuit 110. The relays 194 to 197 each maintain a "radius of surveillance" on the corresponding tracks 12. Once a train on any track enters the "radius of surveillance" of one of the relays 194 to 197, the relay is de-activated thereby causing its corresponding lockout contact 198 to 201 to return to the open position. This in turn isolates the locking and movement control circuits 108 and 110 from the 110 v source, thereby maintaining track section 20 in its aligned position with either Track A or Track B. Thus, when a train at any time enters a "radius of surveillance" of one of the relays 194 to 197, the track section 20 will automatically be prohibited from unlocking or moving so that the track section is prevented from movement even if the train for some reason stops across the switch and its control signal is off.

Referring now to FIGS. 3, 4 and 5, at least one normally open limit switch 186 is located at each of the ends of Track A and Track B. As shown in FIG. 3, the limit switch 186 is connected to the upper rear end of locking pin sleeve 70. As more clearly illustrated in FIGS. 2, 4 and 5, when the locking pin 30 is retracted from the locking pin sleeve 70 the limit switch 186 and the limit switch 188 on the ends of Track B are opened, thereby de-energizing high voltage contact relay 190 (see FIG. 6) which in turn de-energizes track section 20.

Once track section 20 is de-energized, any subsequent train (not shown) on Track B that approaches the crossover switch will sense a variation in the control signal as the train (not shown) approaches the de-energized track section 20. As previously described, the train (not shown) will automatically stop within a preselected distance of the nonaligned or de-energized track section 20 when the control signal rises to the preselected level.

After the track section 20 has been rotated into alignment with Track A, the locking pins 30 will be hydraulically driven so as to mate with the locking pin sleeves 70 (see FIG. 2) of Track A. As the locking pins 30 are fully extended, they will engage normally open limit switches 182 and 184 (see FIGS. 2 and 6) and will forcibly depress them to the closed position.

Referring now to FIG. 6, normally closed contact 180 of the power control circuit 112 will have been returned to its normally closed position by the deenergization of relay 154 as the rotatable track section 20 is aligned with Track A and forcibly depresses normally closed limit switch 150 of the track position control circuit 106. Thus, since normally closed contact 180 will have been closed, the locking pins 30 will energize the high voltage contacting coil 192 of the power control circuit 112 as the locking pins 30 engage and forcibly close normally open limit switches 182 and 184 located at the rear of locking pin sleeves 70 on the ends of Track A. As high voltage contacting coil 192 is energized, power will be restored to track section 20 thereby enabling passage of the approaching train 16 over track section 20.

When train 16 passes over the rotatable switch section 20 the signal voltage drops to zero and the voltage relay 90 is de-energized, thus opening contacts 114 and de-energizing latching relay coil 136. This action will permit later resetting of the disable control circuit 102 to the neutral position. In order to reset the control circuit 82 to the neutral position after the autopiloted train 16 has passed the rotatable track section 20, limit switches 172 and 174 (see FIG. 2) are located on Tracks A and B after section 20. As further illustrated in FIG. 3, the limit switch 172 and the limit switch 174 (not illustrated in FIG. 3) are positioned on the tracks so that as the train 16 passes beyond the rotatable track section, the last car of the train activates the limit switch 174 and closes it temporarily. Referring now to FIG. 6, when the train 16 passes over the rotatable track section 20 and activates the limit switch 174 on Track A, relay 176 is energized temporarily and shifts its related contacts. Normally closed contacts 142 close, resetting the disable control circuit 102, and contacts 138 of the locking mechanism control circuit 108 and contacts 140 of the rotating control circuit 110 both open resetting these circuits. After this sequence the entire control circuit is in the reset position ready for another command sequence.

While rotation of the track section 20 has been described in this preferred embodiment, it will be apparent to one of ordinary skill in the art that the rotary motor 64 and shaft 46 (FIG. 3) could be substituted for laterally translating structures. Such a laterally moving track section (not shown) may be particularly desirable where converging tracks of generally Y-configuration are desired.

The invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A junction switch disposed between the ends of converging tracks on which one or more autopiloted vehicles travel, each said vehicle causing a control signal to be transmitted along the track so as to monitor the track by sensing variations in the control signal, said vehicle automatically stopping when sensing variations of a given magnitude, the switch comprising:

a movable track section;

means for moving the track section into alignment with the path of the nearest approaching vehicle;

means for selectively locking the track section to the ends of the converging tracks;

means for selectively unlocking the track section from the ends of the converging tracks; and a control circuit comprising means for sensing the signal of each approaching vehicle, means for actuating the unlocking means, means for actuating the means for moving the track section in response to the detected signal so as to accommodate use of the movable track section by the nearest approaching vehicle, means for maintaining the track section deenergized until it is locked into alignment with the path of said nearest vehicle, thereby causing a variation in the signal sensed by all vehicles within a preselected distance of the track section so as to disable all such vehicles, means for actuating the locking means, and means for re-energizing the track section when it is locked into alignment.

2. A junction switch as defined in claim 1 wherein said means for moving the track section comprise:

a center support post;

a torque drive motor associated with the center support post;

a vertical shaft connected at one end to the motor and at the other end to the track section; and a plurality of rollers affixed to the bottom of the track section, said rollers facilitating rotational movement of the track section and providing additional support to the track section when rotated.

3. A junction switch as defined in claim 1 wherein said control circuit further comprises means for maintaining the locking means in a locked state so as to lock the track section into an immovable position when the track section is already aligned with the path of the nearest approaching vehicle and means for actuating the locking means so as to unlock the track section when the control circuit senses that the nearest approaching vehicle is on a track with which the track section is nonaligned.

4. A junction switch as defined in claim 1 wherein said locking means comprises:

at least one hydraulically retractable locking pin located at each end of the rotatable track section, the locking pin being tapered at one end; and at least one locking pin sleeve located on each end of each converging track and positioned so as to mate with the tapered end of the locking pins, the sleeves being vertically centered slightly higher than the longitudinal axis of the locking pins so that as the tapered locking pins are mated with the locking pin sleeves, the rotatable track section is lifted into vertical alignment with the converging tracks.

5. A junction switch as defined in claim 4 wherein said means for maintaining the switch de-energized until it is locked into alignment comprises:

at least one limit switch located with each locking pin sleeve, the limit switch being forcibly depressed by the locking pin to connect power to the movable track section, the limit switch being open to disconnect power to the movable track section when the locking pins are withdrawn from the locking pin sleeves.

6. An electrical control circuit for a movable track section disposed between the ends of converging tracks on which one or more autopiloted vehicles travel, each said vehicle causing a control signal to be transmitted along the track so as to monitor the track by sensing variations in the control signal, said vehicle automatically stopping when sensing variations of a given magnitude, the electrical circuit controlling actuation of (1) a prime mover for displacing the movable track section, and (2) a locking mechanism for selectively unlocking and locking the track section to the ends of the converging tracks, the circuit comprising:

means for sensing the signal generated by each approaching vehicle;

means for detecting when the movable track section is nonaligned with the ends of the converging tracks upon which the nearest oncoming vehicle is approaching;

means for actuating the locking mechanism in response to said detected nonalignment so as to unlock the track section;

means for actuating the prime mover in response to both (1) the signal sensed by sensing means and generated by the approaching vehicle and (2) the detected, nonaligned position of the movable track section so as to align the track section with the path of the nearest oncoming vehicle;

means for maintaining the track section de-energized until it is aligned and locked, thereby causing a variation in the signal sensed by all vehicles within a preselected distance of the track section so as to disable all such vehicles;

means for actuating the locking mechanism so as to lock the track section after it is aligned; and means for re-energizing the track section in response to said actuation of the locking mechanism.

7. An electrical control circuit as defined in claim 6 further comprising means for automatically isolating the actuating means of the prime mover when a vehicle traveling on any one of the tracks comes within a selected distance of the movable track section.

8. An electrical control circuit as defined in claim 6 wherein said means for sensing the signal generated by the approaching vehicle comprises at least one voltage sensing relay coupled to each converging track, the relay sensing a vehicle-generated variable voltage signal transmitted by the track when a vehicle on the track approaches the movable track section, said relay becoming activated when the voltage reaches a pre-set level and thereafter enabling the means for actuating the prime mover.

9. An electrical control circuit as defined in claim 6 wherein said means for actuating the prime mover comprises dual latching relay circuits, alternately enabled and disabled, the enabling mode occurring when both of the following coincidentally occur: (1) the signal of the approaching vehicle is sensed by the sensing means and (2) the detecting means detects nonalignment of the movable track section with the ends of the converging tracks upon which the vehicle is approaching.

10. An electrical control circuit as defined in claim 6 wherein said means for detecting the nonalignment of the movable track section with the ends of the converging tracks comprise a switch positioned on the ends of each converging track, the movable track section activating the switch when moved out of alignment with the converging track.

11. An electrical control circuit as defined in claim 6 wherein said means for selectively actuating the locking mechanism of the movable track section are comprised of alternately acting dual latching relay circuits.

12. An electrical control circuit as defined in claim 6 further comprising means for sensing when the movable track section is locked to the ends of the converging tracks, said means comprising a switch located on the end of each converging track, said switch being activated by the locking mechanism only when the movable track section is locked to the ends of the converging tracks.

13. An electrical control circuit as defined in claim 6 further comprising means for sensing when the movable track section is unlocked from the ends of the converging tracks, said means comprising a switch located on the end of the movable track section, said switch being activated by the locking mechanism only when the movable track section is unlocked from the ends of the converging tracks.

14. A method for automatically positioning a rotatable track section disposed between the ends of converging tracks adapted to carry one or more autopiloted vehicles, each said vehicle causing a control signal to be transmitted along the track so as to monitor the track by sensing variations in the control signal, each said vehicle automatically stopping when sensing variations of a given magnitude, the method comprising the steps of:

sensing the signal generated by each approaching vehicle;

detecting nonalignment of the track section with the path of the nearest oncoming vehicle;

unlocking the rotatable track section in response to the signal of the nearest vehicle whenever said vehicle is on a track that is not aligned with the track section;

de-energizing the rotatable track section when the track section is unlocked from the ends of the converging tracks so as to cause a variation in the signal transmitted along the converging tracks, thereby disabling all oncoming vehicles within a preselected distance of the track section;

rotating the track section into alignment with the path of said nearest vehicle after the track section has been unlocked;

relocking the track section to the ends of the converging track after the track is aligned; and energizing the track section when the track section is locked in the aligned position, the energized track section providing a continuous path for the control signal sensed by said nearest vehicle.

15. A method as defined in claim 14 further comprising inhibiting said unlocking step when said track section is already in alignment with the path of the oncoming vehicle.

16. A method as defined in claim 14 further comprising the steps of:

lowering the rotatable track section out of the horizontal plane of the converging tracks onto a plurality of rollers after unlocking the track section from the ends of converging tracks; and raising the rotatable track section off the rollers and back into the horizontal plane formed by the ends of the converging tracks when the track section is relocked to the ends of the converging tracks thereby using the rollers for support only during rotation of the track section.

17. A method as defined in claim 14 further comprising:

sensing the presence of a vehicle on any converging track within a selected distance of the rotatable track section; and inhibiting rotation of the track section once the presence of a vehicle on any converging track has been sensed within the selected distance.

18. An automated mass transit switching system comprising in combination:

a plurality of converging tracks;

at least one vehicle adapted to travel on said tracks, said vehicle causing a control signal to be transmitted along the tracks ahead of it so as to sense any open portion of track ahead of it, said vehicle automatically stopping in response to an open portion of track sensed; and a junction switch disposed between the ends of said converging tracks, said junction switch comprising:

means for sensing the approach of any oncoming vehicle by detecting the electric signal originating with the vehicle;

means for moving the switch into alignment with the path of the nearest oncoming vehicle in response to the vehicle originated signals;

means for disabling said moving means when the track is in alignment with the path of the nearest oncoming vehicle until said nearest oncoming vehicle has passed the switch; and means for securing the switch in alignment position.

19. An automated mass transit switching system comprising in combination:

a plurality of energized converging tracks;

at least one automated carrier adapted to travel on said tracks, said carrier causing a control signal to be transmitted along the tracks ahead of it so as to monitor the tracks, the carrier automatically stopping whenever it detects a variation of given magnitude in the control signal;

an automated, on-grade movable track section that is energized and that is disposed between the converging ends of said energized tracks;

a prime mover for selectively aligning the track section with one of the converging tracks;

a locking mechanism for selectively unlocking and locking the track section to the ends of the converging tracks; and a control circuit comprising means for detecting the signal of each oncoming carrier, means for detecting nonalignment of the track section with the track of the nearest oncoming vehicle, means for causing the prime mover to align the track section with the track of the nearest oncoming vehicle in response to said signals and in response to said detected nonalignment, means maintaining said track section de-energized when the track section is unlocked, thereby disabling all oncoming vehicles within a preselected distance of the switch by causing a variation in the control signal transmitted along the tracks, and means for locking and reenergizing the track section when it is aligned with the track of the nearest oncoming vehicle so as to enable that vehicle.

20. An automated mass transit switching system as defined in claim 19 wherein said control circuit further comprises:

means for disabling the prime move whenever the track section is locked into alignment with the track of the nearest oncoming vehicle; and means for disabling the prime mover whenever any vehicle comes within a preselected distance of the track section.

* * * * *